US011649681B2

(12) United States Patent
Dunbar

(10) Patent No.: US 11,649,681 B2
(45) Date of Patent: May 16, 2023

(54) FIXED-CUTTER DRILL BITS WITH REDUCED CUTTING ARC LENGTH ON INNERMOST CUTTER

(71) Applicant: Halliburton Energy Services, Inc., Houston, TX (US)

(72) Inventor: Bradley David Dunbar, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 28 days.

(21) Appl. No.: 17/282,717

(22) PCT Filed: Nov. 7, 2018

(86) PCT No.: PCT/US2018/059648

§ 371 (c)(1),
(2) Date: Apr. 2, 2021

(87) PCT Pub. No.: WO2020/096590

PCT Pub. Date: May 14, 2020

(65) Prior Publication Data

US 2022/0003047 A1 Jan. 6, 2022

(51) Int. Cl.

| | |
|---|---|
| ***E21B 10/567*** | (2006.01) |
| ***E21B 10/43*** | (2006.01) |
| *E21B 3/04* | (2006.01) |

(52) U.S. Cl.
CPC ..... *E21B 10/5673* (2013.01); *E21B 10/43* (2013.01); *E21B 3/04* (2013.01)

(58) Field of Classification Search
CPC ..... E21B 10/43; E21B 10/55; E21B 10/567; E21B 10/5671; E21B 10/5673; E21B 10/5676
See application file for complete search history.

(56) References Cited

U.S. PATENT DOCUMENTS 4,352,400 A 10/1982 Grappendorf et al.
4,981,183 A * 1/1991 Tibbitts ..... E21B 10/48 175/405.1

(Continued)

OTHER PUBLICATIONS

International Search Report for PCT Patent Application No. PCT/US2018/059648, dated Aug. 1, 2019; 4 pages.

(Continued)

*Primary Examiner* — Blake Michener
(74) *Attorney, Agent, or Firm* — Michael Jenney; C. Tumey Law Group PLLC

(57) ABSTRACT

The present disclosure provides a fixed-cutter drill bit including a bit body defining a bit rotational axis, a plurality of blades each having an inner end that is radially closer to the bit rotational axis than a remainder of the respective blade, a central bit surface, and a plurality of cutters disposed on the blades and including an innermost cutter located closest among all of the plurality of cutters to the bit rotational axis and having a flattened cutting surface, a cutting arc, and a relief having ends which is located within and interrupts the cutting arc such that the cutting arc includes at least two portions located on opposite ends of the relief. The disclosure also provides a drilling system including the drill bit and a drill string attached to the drill bit and a surface assembly to rotate the drill string and drill bit.

20 Claims, 9 Drawing Sheets

(56) References Cited

U.S. PATENT DOCUMENTS

| | | | | |
|---|---|---|---|---|
| 5,740,874 | A * | 4/1998 | Matthias | E21B 10/5673 175/430 |
| 6,003,623 | A | 12/1999 | Miess | |
| 6,244,365 | B1 * | 6/2001 | Southland | E21B 10/5673 175/434 |
| 6,904,984 | B1 * | 6/2005 | Estes | E21B 10/5673 175/430 |
| 9,808,910 | B2 * | 11/2017 | Sani | E21B 4/003 |
| D911,399 | S * | 2/2021 | Atkins | D15/139 |
| 2001/0030063 | A1 | 10/2001 | Dykstra et al. | |
| 2002/0108790 | A1 * | 8/2002 | Eyre | E21B 10/006 175/431 |
| 2004/0149495 | A1 * | 8/2004 | Thigpen | E21B 10/5673 175/426 |
| 2009/0057031 | A1 * | 3/2009 | Patel | E21B 10/5673 175/420.2 |
| 2010/0059287 | A1 * | 3/2010 | Durairajan | E21B 10/5673 175/420.2 |
| 2010/0300765 | A1 | 12/2010 | Zhang et al. | |
| 2011/0192651 | A1 | 8/2011 | Lyons et al. | |
| 2011/0278073 | A1 | 11/2011 | Gillis | |
| 2020/0032588 | A1 * | 1/2020 | Izbinski | E21B 10/5735 |
| 2021/0002962 | A1 * | 1/2021 | Cheng | E21B 10/5673 |
| 2021/0381317 | A1 * | 12/2021 | Atkins | E21B 10/5673 |

OTHER PUBLICATIONS

International Written Opinion for PCT Patent Application No. PCT/US2018/059648, dated Aug. 1, 2019; 6 pages.

* cited by examiner

FIXED-CUTTER DRILL BITS WITH REDUCED CUTTING ARC LENGTH ON INNERMOST CUTTER

RELATED APPLICATIONS

This application is a U.S. National Stage Application of International Application No. PCT/US2018/059648 filed Nov. 7, 2018, which designates the United States.

TECHNICAL FIELD

The present disclosure relates generally to fixed-cutter drill bits.

BACKGROUND

Wellbores are most frequently formed in geological formations using rotary drill bits. Various types of rotary bits exist, but all of them experience some type of wear or fatigue from use that limits the overall life of the bit or the time it may spend downhole in the wellbore before being returned to the surface. The materials used in the bit and their ability to effectively cut different types of formations encountered as the wellbore progresses also sometimes necessitate removing the bit from the wellbore, replacing bit or components of it, and returning it downhole to resume cutting.

Particularly as wellbores reach greater lengths, the process of removing and returning a bit becomes increasingly time consuming and costly. Those who design, manufacture, and operate earth-boring drill bits and their components have an interest in improving the life of drill bit and their components.

BRIEF DESCRIPTION OF THE DRAWINGS

A more complete understanding of the present disclosure and its features and advantages thereof may be acquired by referring to the following description, taken in conjunction with the accompanying drawings, which are not necessarily to scale, in which like reference numbers indicate like features, with the addition of a, b, c, indicting variations of like features, –1 indicating a particular subset feature, and i, ii, etc. indicating additive parts of a feature, and wherein.

DETAILED DESCRIPTION

The present disclosure relates to fixed-cutter drill bits in which the cutting arc length of the innermost cutter is reduced, as well as systems for using such fixed-cutter drill bits to drill a wellbore in a geological formation.

The present disclosure may be further understood by referring to FIGS. 1-11, where like numbers are used to indicate like and corresponding parts.

Figure 1:
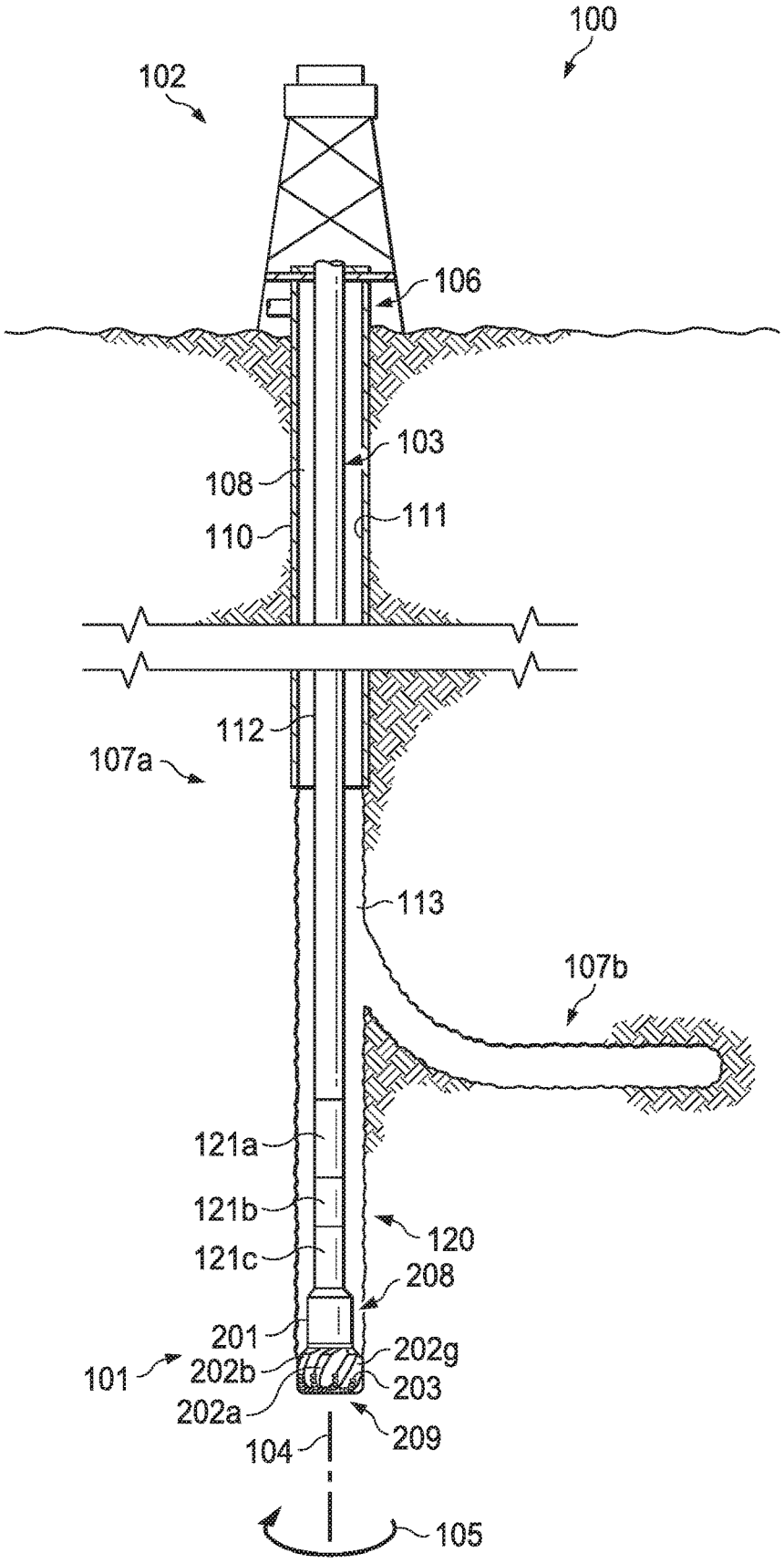
FIG. 1 is a schematic diagram of a drilling system in which a fixed-cutter drill bit in which the cutting arc length of the innermost cutter is reduced may be used.

FIG. 1 is a schematic diagram of a drilling system 100 configured to drill into one or more geological formations to form a wellbore 107, sometimes also referred to as a borehole. Drilling system 100 may include a fixed-cutter drill bit 101 according to the present disclosure.

Drilling system 100 may include well surface or well site 106. Various types of drilling equipment such as a rotary table, mud pumps and mud tanks (not expressly shown) may be located at a well surface or well site 106. For example, well site 106 may include drilling rig 102 that may have various characteristics and features associated with a "land drilling rig." However, fixed-cutter drill bits 101 according to the present disclosure may be satisfactorily used with drilling equipment located on offshore platforms, drill ships, semi-submersibles and drilling barges (not expressly shown).

Drilling system 100 may include drill string 103 associated with fixed-cutter drill bit 101 that may be used to rotate fixed-cutter drill bit 101 in radial direction 105 around bit rotational axis 104 of form a wide variety of wellbores 107 such as generally vertical wellbore 107*a* or generally horizontal wellbore 107*b* as shown in FIG. 1. Various directional drilling techniques and associated components of bottom hole assembly (BHA) 120 of drill string 103 may be used to form generally horizontal wellbore 107*b*. For example, lateral forces may be applied to drill bit 101 proximate kickoff location 113 to form generally horizontal wellbore 107*b* extending from generally vertical wellbore 107*a*. Wellbore 107 is drilled to a drilling distance, which is the distance between the well surface and the furthest extent of wellbore 107, and which increases as drilling progresses.

BHA 120 may be formed from a wide variety of components configured to form a wellbore 107. For example, components 121*a*, 121*b* and 121*c* of BHA 120 may include, but are not limited to fixed-cutter drill bit 101, drill collars, rotary steering tools, directional drilling tools, downhole drilling motors, reamers, hole enlargers or stabilizers. The number of components such as drill collars and different types of components 121 included in BHA 120 may depend upon anticipated downhole drilling conditions and the type of wellbore that will be formed by drill string 103 and fixed-cutter drill bit 101.

Wellbore 107 may be defined in part by casing string 110 that may extend from well site 106 to a selected downhole location. Various types of drilling fluid may be pumped from well site 106 through drill string 103 to attached drill bit 101. Such drilling fluids may be directed to flow from drill string 103 to respective nozzles (item 156 illustrated in FIG. 2A) included in fixed-cutter drill bit 101. The drilling fluid may be circulated back to well surface 106 through annulus 108 defined in part by outside diameter 112 of drill string 103 and inside diameter 111 of casing string 110.

Figure 2:
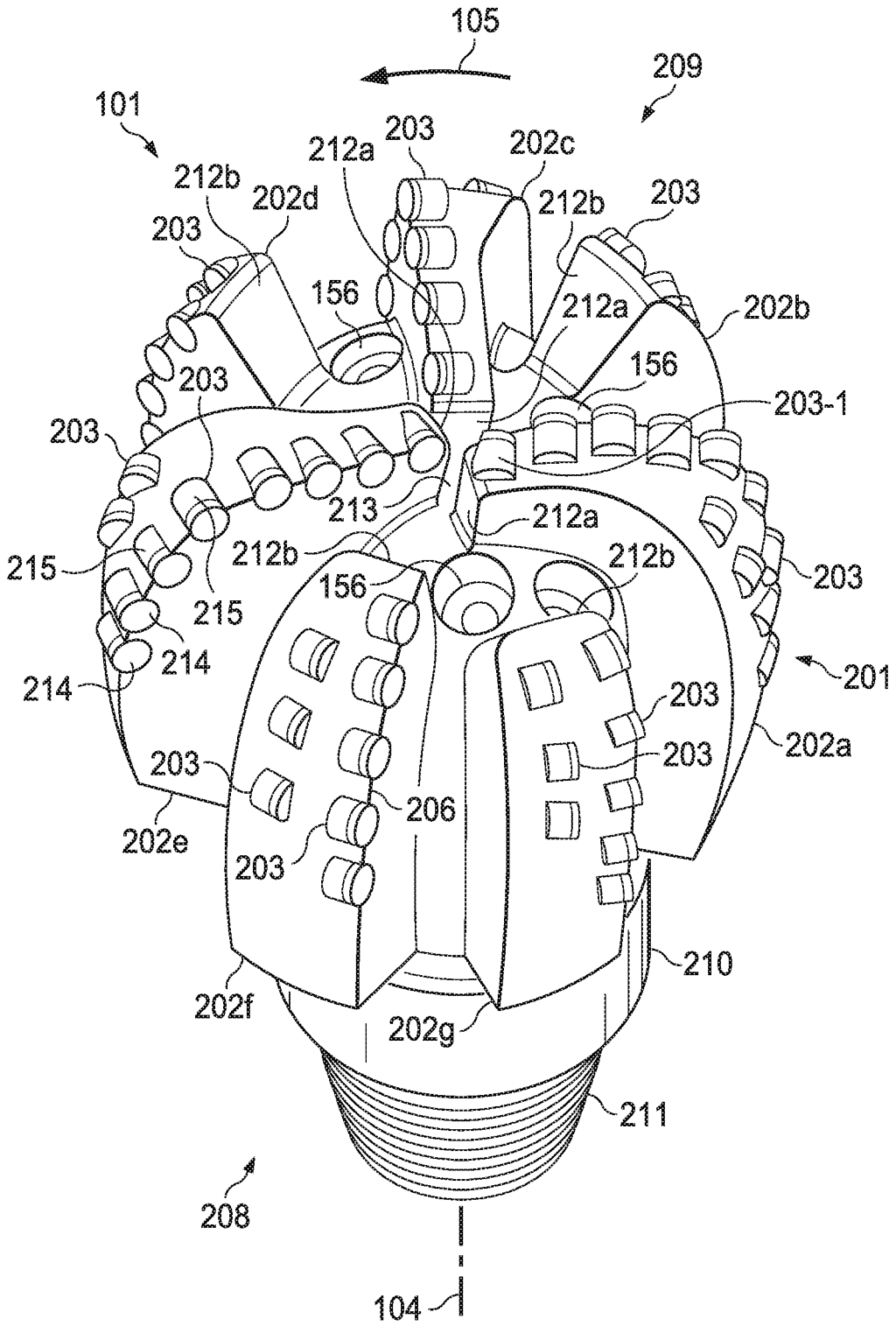
FIG. 2 is an isometric view of a fixed-cutter drill bit with in which the cutting arc length of the innermost cutter is reduced.

FIG. 2 is an isometric view of fixed-cutter drill bit 101 oriented upwardly in a manner often used to model or design fixed-cutter drill bits. Fixed-cutter drill bit 101 may be designed and formed in accordance with teachings of the present disclosure and may have many different designs, configurations, and/or dimensions according to the particular application of drill bit 101.

Uphole end 204 of fixed-cutter drill bit 101 may include shank 210 with drill pipe threads 211 formed thereon. Threads 211 may be used to releasably engage fixed-cutter drill bit 101 with BHA 120 (as shown in FIG. 1), whereby fixed-cutter drill bit 101 may be rotated relative to bit rotational axis 104. Downhole end 209 of fixed-cutter drill bit 101 may include a plurality of blades 202*a*-202*g* with respective junk slots or fluid flow paths disposed therebetween. Additionally, drilling fluids may be communicated to one or more nozzles 156.

The plurality of blades 202 (e.g., blades 202*a*-202*g*) may be disposed outwardly from the exterior of bit body 201 of fixed-cutter drill bit 101. Bit body 201 may be generally cylindrical and blades 202 may be any suitable type of projections extending outwardly (i.e. in a radial direction from rotational axis 104) from bit body 201. For example, a portion of blade 202 may be directly or indirectly coupled to the exterior of bit body 201, while another portion of blade 202 is projected away from the exterior of bit body 201. Blades 202 may have a wide variety of configurations including, but not limited to, substantially arched, helical, spiraling, tapered, converging, diverging, symmetrical, and/or asymmetrical.

In some cases, one or more blades 202 may have a substantially arched configuration extending from proximate bit rotational axis 104 of fixed-cutter drill bit 101. The arched configuration may be defined in part by a generally concave, recessed shaped portion extending from proximate bit rotational axis 104. The arched configuration may also be defined in part by a generally convex, outwardly curved blade portion disposed between the concave, recessed blade portion and outer portions of each blade which correspond generally with the outside diameter of the rotary drill bit.

Blades 202*a*-202*g* may include primary blades disposed about the bit rotational axis.

For example, in FIG. 2, blades 202*a*, 202*c*, and 202*e* may be primary blades or major blades because respective inner ends 212*a* of each of blades 202*a*, 202*c*, and 202*e* may be disposed closely adjacent to the bit rotational axis 104 and closer to associated bit rotational axis 104 than the remainder for the respective blades. Blades 202*a*-202*g* may also include at least one secondary blade disposed between the primary blades. Blades 202*b*, 202*d*, 202*f*, and 202*g* shown in FIG. 2 on fixed-cutter drill bit 101 may be secondary blades or minor blades because respective inner ends 212*b* may be disposed on downhole end 209 a distance from associated bit rotational axis 104. For example, the closest of inner ends 212*b* may have a closest distance from bit rotational axis 104 that is at least 1.5 times, at least 2 times, at least 3 times, or between 1.5 and 5 times, between 2 and 5 times, or between 3 and 5 times, inclusive, of the distance of the farthest of inner ends 212*a* from bit rotational axis 104. The number and location of secondary blades and primary blades may vary such that fixed-cutter drill bit 101 includes fewer or greater secondary and primary blades than are shown in FIG. 2. Blades 202 may be disposed symmetrically or asymmetrically with regard to each other and bit rotational axis 104 where the disposition may be based on the downhole drilling conditions of the drilling environment.

Inner ends 212*a* of blades 202*a*, 202*c*, and 202*e*, are disposed closely adjacent to bit rotational axis 104. Inner ends 212*a*, along with a portion of bit body 201, form a central bit surface 213. During drilling, formation downhole of central bit surface 213 may either fracture and degrade with the surrounding formation during drilling, or it may form a short column of uncut formation. If a column of uncut formation is formed, it may then contacted by central bit surface 213 and crushed or destroyed as drilling progresses. The column of uncut formation is not retained by fixed-cutter drill bit 101 and may not be removed to the surface of wellbore 107 using fixed-cutter drill bit 101 or drill string 103.

Central bit surface 213 may be adapted to limit wear if it crushes or destroys uncut formation or as a result of drilling fluid flow. For example, portions of central bit surface 213, such as inner ends 212*a*, a portion of bit body 201, or an outer portion of a nozzle 156, may formed from or coated with a wear-resistant material, such as polycrystalline diamond or tungsten carbide.

Any two, a plurality of, or all of inner ends 212*a* may have a longest distance from one another through bit rotational axis 104 that is between 0.000 inches and 0.500 inches. Alternatively, any two, a plurality of, or all of inner ends 212*a* may have a longest distance from one another through bit rotational axis 104 that is between 0 and 1/12 the total diameter of bit 101.

In fixed-cutter drill bits 101 that do not have primary and secondary blades, all inner ends 212 may be treated in the same manner as inner ends 212*a* as described herein.

Blades 202 and fixed-cutter drill bit 101 may rotate about bit rotational axis 104 in a direction defined by directional arrow 105. Each blade 202 may have a leading (or front) surface disposed on one side of the blade in the direction of rotation of fixed-cutter drill bit 101 and a trailing (or back)

surface disposed on an opposite side of the blade away from the direction of rotation of fixed-cutter drill bit 101. Blades 202 may be positioned along bit body 201 such that they have a spiral configuration relative to bit rotational axis 104. Alternatively, blades 202 may be positioned along bit body 201 in a generally parallel configuration with respect to each other and bit rotational axis 104.

Blades 202 include one or more cutters 203 disposed outwardly from outer portions of each blade 202. For example, a portion of a cutter 203 may be directly or indirectly coupled to an exterior portion of blade 202 while another portion of the cutter 203 may be projected away from the exterior portion of blade 202. Cutters 203 may be any suitable device configured to cut into a formation, such as various types of compacts, buttons, inserts, and gage cutters satisfactory for use with a wide variety of fixed-cutter drill bits 101.

One or more of cutters 203 may include a substrate with a layer of hard cutting material 219 disposed on one end of the substrate 220. The layer of hard cutting material 219 may be a compact, such as a polycrystalline diamond compact. The substrate may be a carbide, such as tungsten carbide. The layer of hard cutting material 219 may provide a cutting surface 214 of cutter 203, a portion of which may engage adjacent portions of the formation to form wellbore 107. The contact of the cutting surface 214 with the formation may form a cutting zone associated with each of cutter 203. The edge of the cutting surface 214 located within the cutting zone may be referred to as the cutting edge of a cutter 203. If cutter 203 has a cutting surface that is circular or circular in cross-section, then the cutting edge will have an arced portion referred to as the cutting arc. The length of the arced portion of the cutting edge is referred to as the cutting arc length. Cutter 203 may also include a side surface 215.

Figure 3:
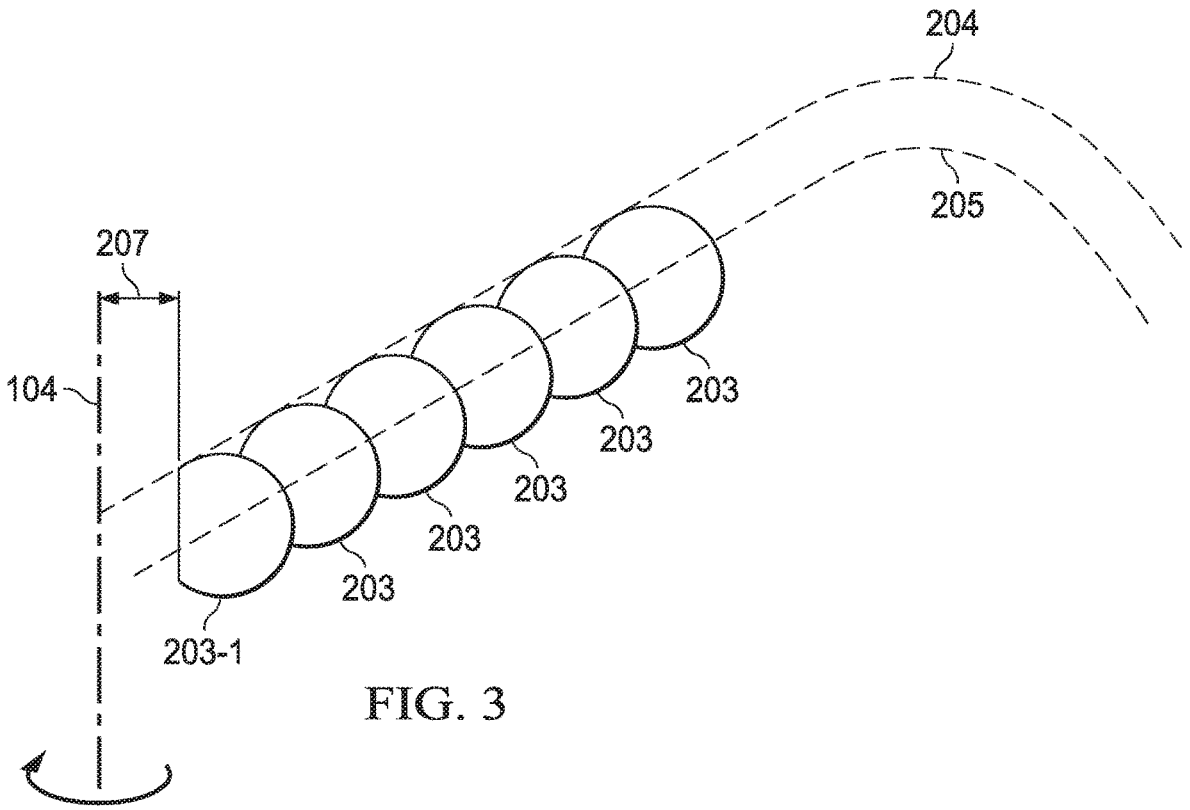
FIG. 3 is a bit profile of the fixed-cutter drill bit of FIG. 2.
Figure 4:
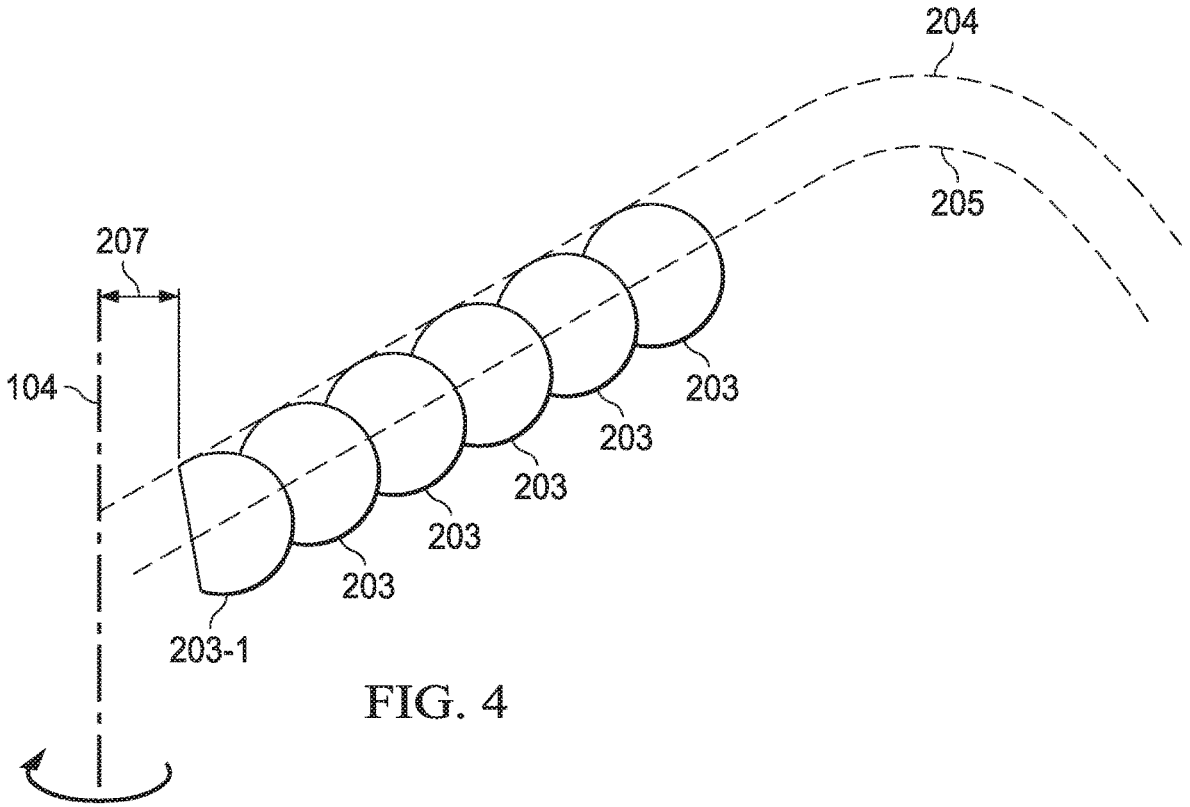
FIG. 4 is another bit profile of a fixed-cutter drill bit such as that of FIG. 2.

FIG. 3 and FIG. 4 are bit profiles for fixed-cutter drill bits both having a cutter profile 204, corresponding to the cutters 203 prior to use of the bit to form a wellbore. The bit profiles also illustrate blade profiles 205, which correspond to the exterior surfaces 206 of blades 202 near cutters 203.

Innermost cutter 203-1, which may also be referred to a cutter number one, is the single cutter, among all of the cutters 203 on the fixed-cutter drill bit 101, located closest to the bit rotational axis 104. Innermost cutter 203-1 may have a relief that is located within and interrupts its cutting arc so that the cutting arc has at least two portions located at opposite ends of the relief. In addition, innermost cutter 203-1 has a reduced cutting arc length as compared to a flat circular cutting arc length of a similar cutter with a cutting surface that is both flat and entirely circular. As a result, fixed-cutter drill bit 201 may have a track diagram in which the profile of innermost cutter 203-1 is reduced on the side adjacent bit rotational axis 104, as shown in FIG. 3 or in FIG. 4.

As shown in FIG. 3, the profile of innermost cutter 203-1 may be circular throughout the majority of the profile, but linear in an area corresponding to the relief on the side adjacent bit rotational axis 104 and generally parallel to bit rotational axis 104, such that the linear profile may form an angle of within +/−2° of bit rotational axis 104.

As shown in FIG. 4, the profile of innermost cutter 203-1 may be linear in an area corresponding to the relief on the side adjacent bit rotational axis 104 and may form an acute angle with the uphole end of bit rotational axis 104. The acute angle may be greater than 2° and less than and inclusive of 20°, or greater than 2° and less than and inclusive of 10°.

If innermost cutter 203-1 has a non-linear profile in the area corresponding to the relief, then a generally linear approximation of the non-linear profile may have the same properties as the linear profile illustrated in FIG. 3 and FIG. 4.

Innermost cutter 203-1 may also have a non-linear profile in an area corresponding to the relief on the side adjacent the bit rotational axis which may be generally linearly approximated. For example, the profile may be wavy, angular, or curved on the side adjacent bit rotational axis 104 in manner that is reduces the surface area of the profile as compared to if it were circular over the entire profile. For example, it may reduce the surface area by at least 5%, at least 10%, at least 20%, or by between 5% and 45%, between 5% and 30%, between 5% and 20%, between 10% and 45%, between 10% and 30%, between 20% and 30%, between 20% and 45%, or between 20% and 30%, inclusive.

The closest distance 207 between the innermost cutter 203-1 and the bit rotational axis 104 may be between −0.01 inch and +0.25 inch, inclusive.

Figure 5A:
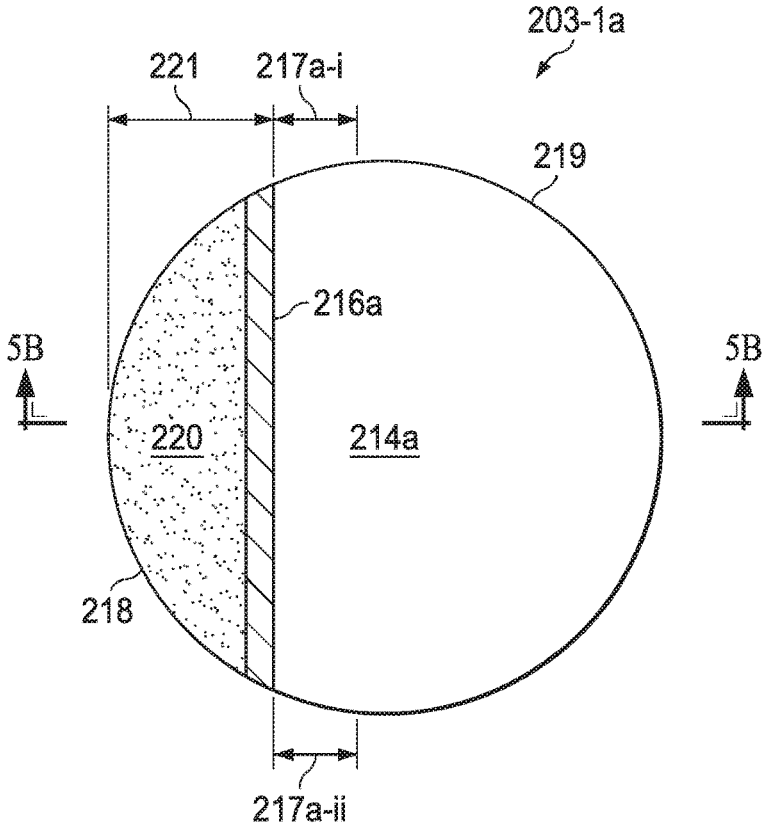
FIG. 5A is a schematic cutting view diagram of an innermost cutter of the fixed-cutter drill bit of FIG. 2, with a relieved cutting surface. An example cutting arc length of the relieved cutting surface is illustrated along with a comparative cutting arc length of a similar cutter without a relieved cutting surface.
Figure 5B:
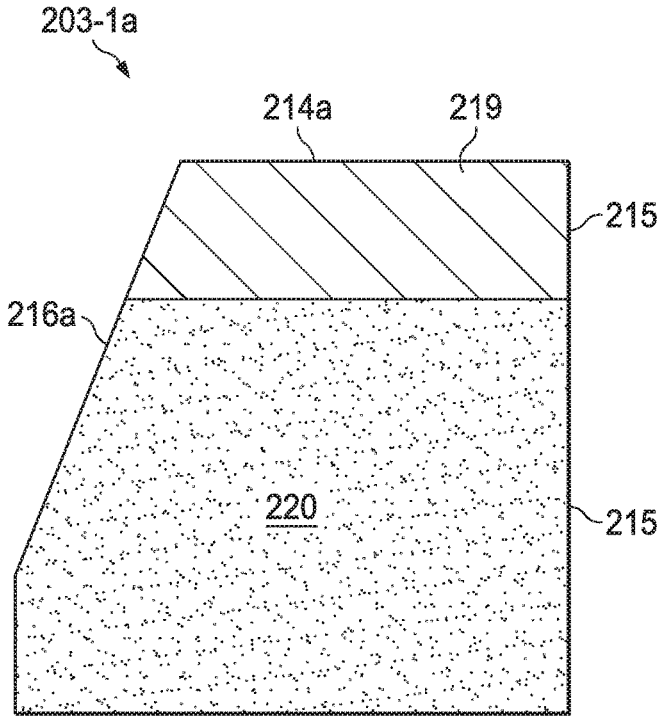
FIG. 5B is a schematic cross-sectional diagram of the cutter of FIG. 4A.

FIG. 5A and FIG. 5B show an innermost cutter 203-1*a* with a relieved cutting surface 214*a*. Relieved cutting surface 214*a* is flattened and circular or oval over the majority of cutting surface 214*a*, with the exception of relief 216*a*, which is linear and which is located within and interrupts the cutting arc of the innermost cutter 203-1*a*. Alternatively, cutting surface 214*a* might be ovoid. Cutting surface 214*a* may exhibit a profile as shown in FIG. 3 or FIG. 4, depending on its orientation in fixed-cutter dill bit 101. Cutting surface 214*a* has a cutting arc length 217*a* which is the sum of the length of the two circular portions 217*a-i* and 217*a-ii*. Cutting arc length 217*a* is less than a flat circular or oval cutting arc length 218 that would be exhibited if the cutting surface 214*a* were entirely circular or oval. Cutting arc length 217*a* may be reduced as compared to flat circular (if cutting surface 214*a* is circular) or oval (if cutting surface 214*a* is oval) cutting arc length 218 by at least 5%, at least 10%, at least 20%, or by between 5% and 45%, between 5% and 30%, between 5% and 20%, between 10% and 45%, between 10% and 30%, between 20% and 30%, between 20% and 45%, or between 20% and 30%, inclusive.

Figure 6A:
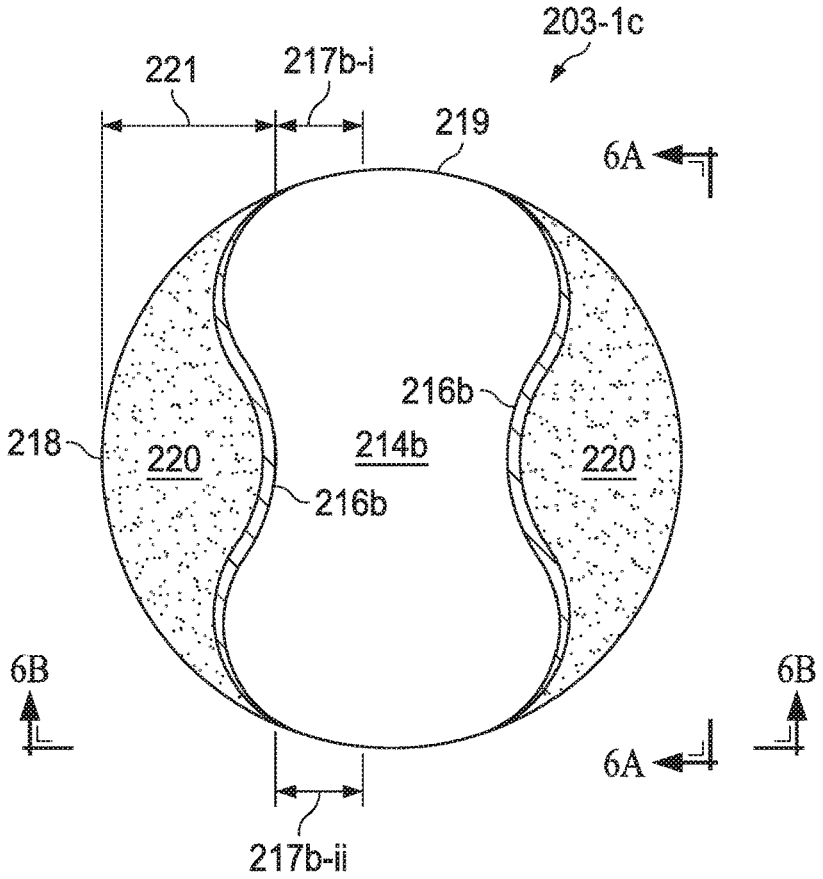
FIG. 6A is a schematic cutting view diagram of another innermost cutter that may be used in the of the fixed-cutter drill bit of FIG. 2, with a relieved cutting surface. An example cutting arc length of the relieved cutting surface is illustrated along with a comparative cutting arc length of a similar cutter without a relieved cutting surface.
Figure 6B:
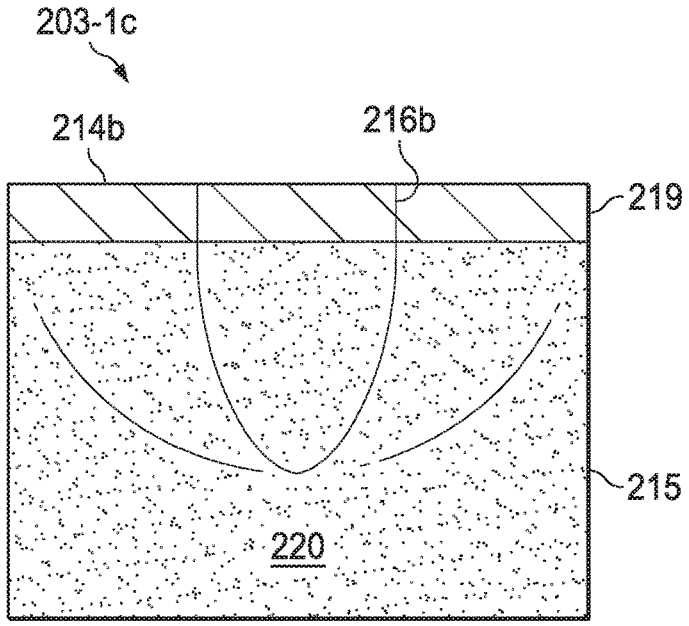
FIG. 6B is a schematic cross-sectional diagram of the cutter of FIG. 6A on side A as indicated in FIG. 6A.
Figure 6C:
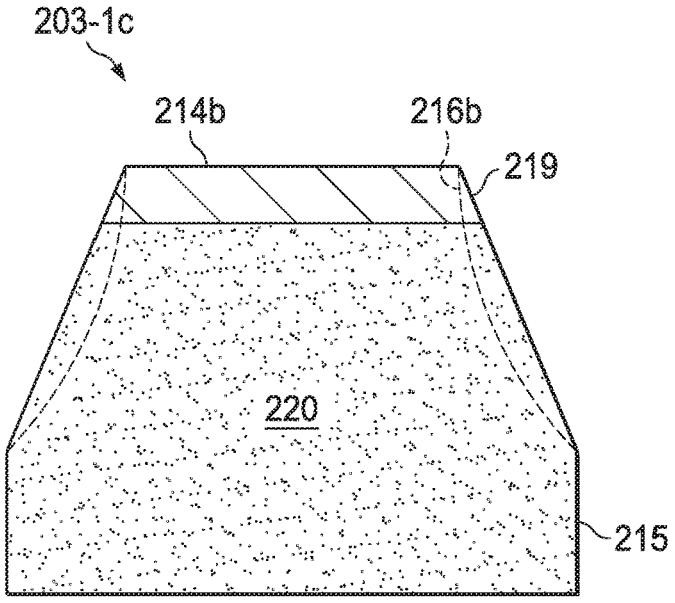
FIG. 6C is a schematic cross-sectional diagram of the cutter of FIG. 6A on side B as indicated in FIG. 6A.
Figure 6D:
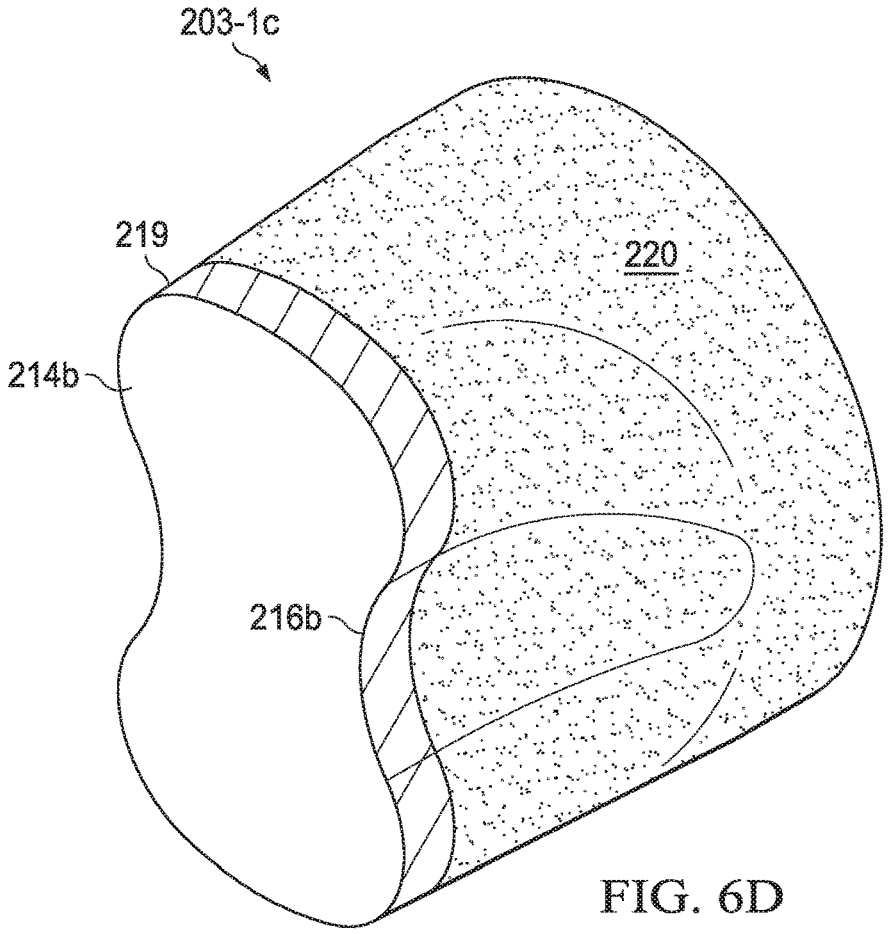
FIG. 6D is a schematic elevation diagram of the cutter of FIG. 6A.
Figure 7:
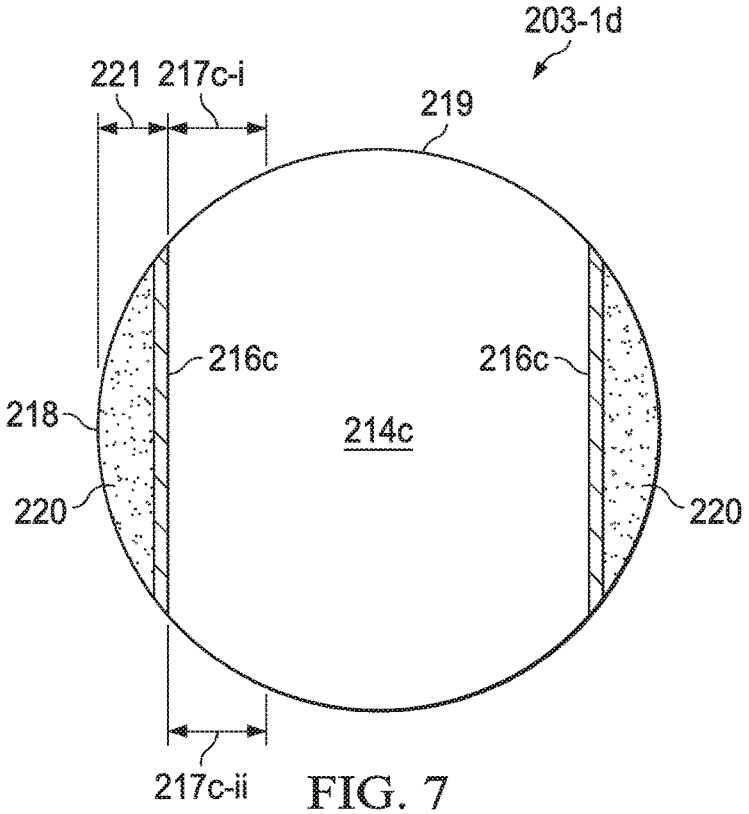
FIG. 7 is a schematic cutting view diagram of another innermost cutter that may be used in the of the fixed-cutter drill bit of FIG. 2, with a relieved cutting surface. An example cutting arc length of the relieved cutting surface is illustrated along with a comparative cutting arc length of a similar cutter without a relieved cutting surface.
Figure 8:
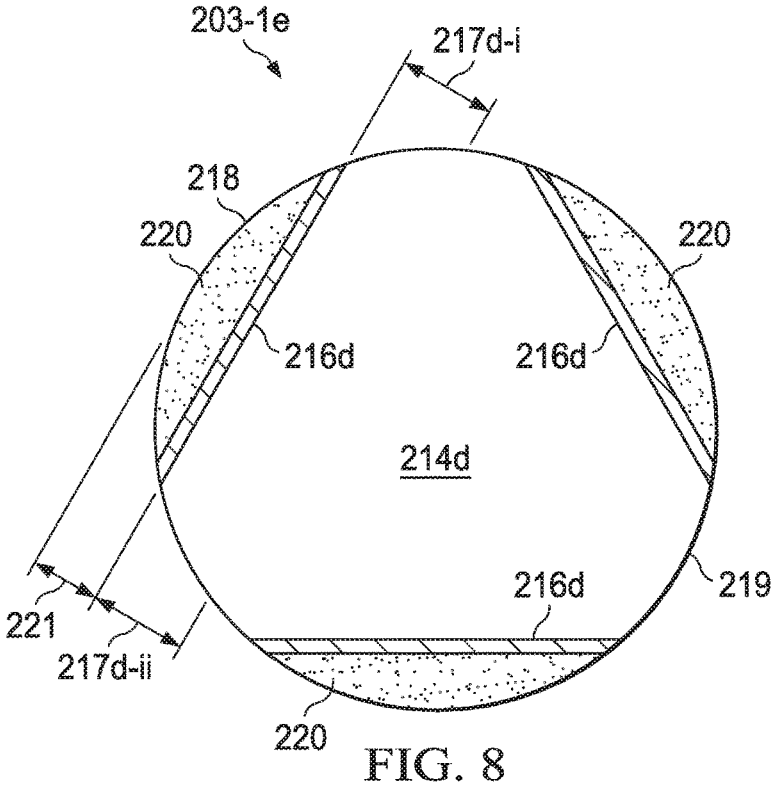
FIG. 8 is a schematic cutting view diagram of another innermost cutter that may be used in the of the fixed-cutter drill bit of FIG. 2, with a relieved cutting surface. An example cutting arc length of the relieved cutting surface is illustrated along with a comparative cutting arc length of a similar cutter without a relieved cutting surface.
Figure 9:
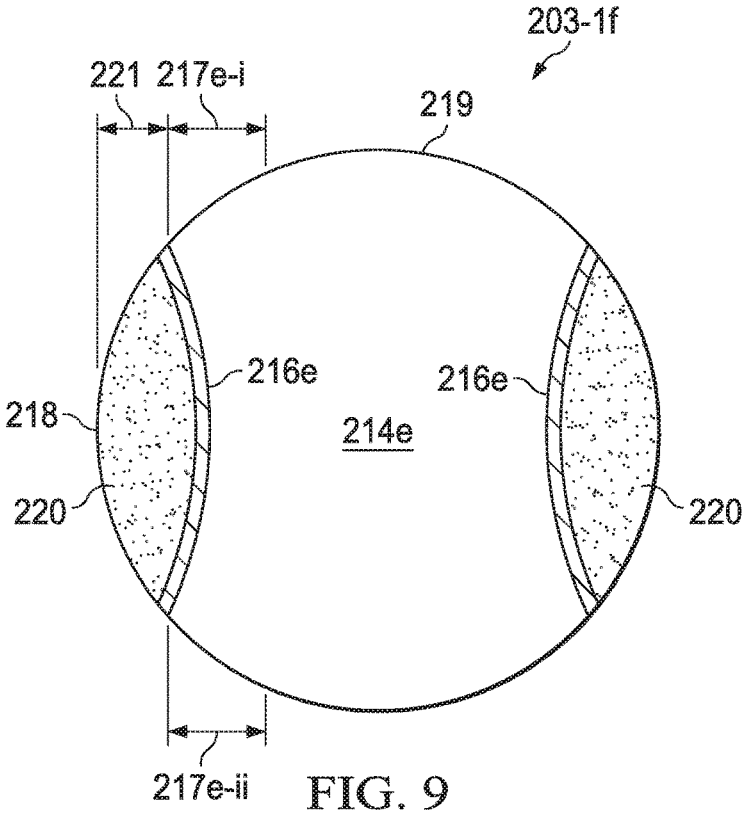
FIG. 9 is a schematic cutting view diagram of another innermost cutter that may be used in the of the fixed-cutter drill bit of FIG. 2, with a relieved cutting surface. An example cutting arc length of the relieved cutting surface is illustrated along with a comparative cutting arc length of a similar cutter without a relieved cutting surface.
Figure 10:
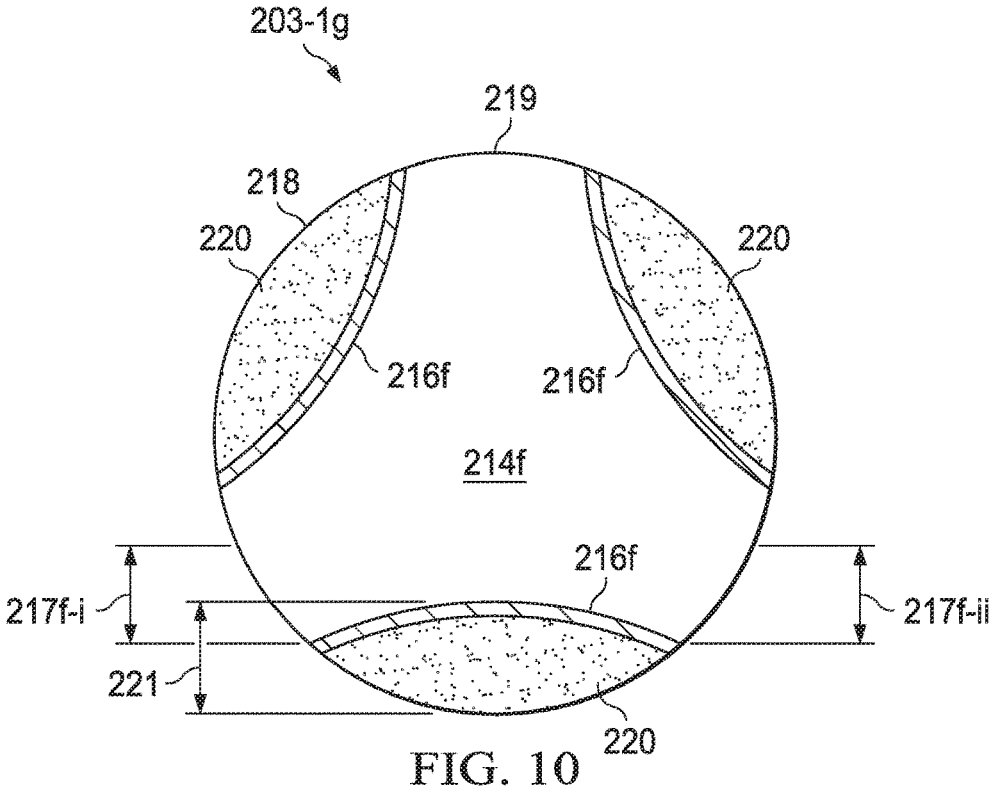
FIG. 10 is a schematic cutting view diagram of another innermost cutter that may be used in the of the fixed-cutter drill bit of FIG. 2, with a relieved cutting surface. An example cutting arc length of the relieved cutting surface is illustrated along with a comparative cutting arc length of a similar cutter without a relieved cutting surface.

As shown in FIGS. 6A, 6B, 6C, 6D, 7, 8, 9, 10, and 11, for innermost cutter 203-1 also having a flattened cutting surface 214, relief 216 may also be wavy, angled, or curved. Also as shown in FIGS. 6A-11, innermost cutter 203-1 may have more than one reliefs 216, allowing the cutter to be rotated in a pocket in the fixed-cutter drill bit 101 once worn on one side and used to continue to drill without replacement of innermost cutter 203-1. For simplicity, only one cutting arc length 217 is illustrated in FIGS. 6A-11. If innermost cutter 203-1 were rotated so that another a relief 216 were in the cutting area, then that relief 216 would then have an associated and similar cutting arc length. Typically, if multiple reliefs 216 are present, then they will be similar or identical in geometry and will be placed at regular intervals around the circumference of innermost cutter 203-1, such as with centers on opposite sides of the cutting surface 214 (spaced radially 180 degrees from one another) as illustrated in FIGS. 6A-7, 9 and 11, or with centers spaced radially 120 degrees from one another, as illustrated in FIGS. 8 and 10.

Figure 11:
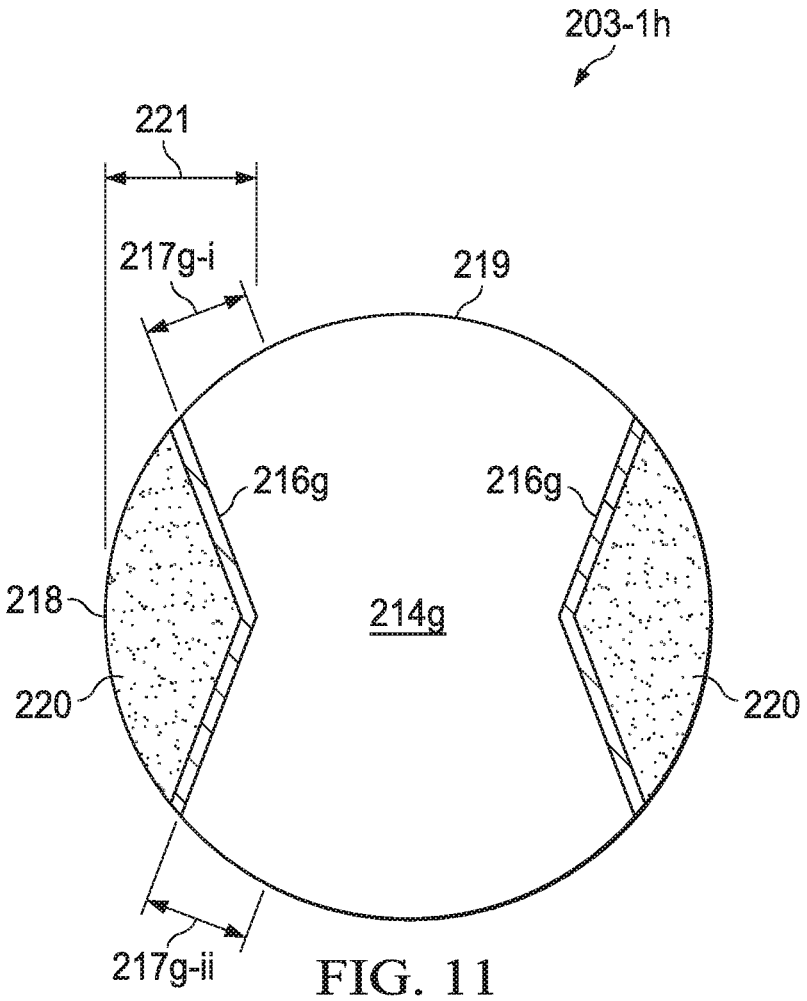
FIG. 11 is a schematic cutting view diagram of another innermost cutter that may be used in the of the fixed-cutter drill bit of FIG. 2, with a relieved cutting surface. An example cutting arc length of the relieved cutting surface is illustrated along with a comparative cutting arc length of a similar cutter without a relieved cutting surface.

As illustrated in FIG. 6A, relief 216*b* may have a wavy profile that extends inward from where the boundaries of flattened cutting surface 214*b* would be if the cutting surface were entirely circular or oval. As illustrated in FIGS. 7 and 8, reliefs 216*c* and 216*d* may both have a linear profile as in FIGS. 5A and 5B, but two reliefs 216*c* with centers on opposite sides of the cutting surface 214*d* (FIG. 7) or three reliefs 216*d* with centers spaced radially 120 degrees from one another on the cutting surface 214*d* (FIG. 8) may be present. As illustrated in FIGS. 9 and 10, reliefs 216*e* and 216*f* may have a curved profile that extends inward from where the boundaries of cutting surface 214 would be if it were entirely circular or oval, with two reliefs 216*e* with centers on opposite sides of the cutting surface 214*e* (FIG. 9) or three reliefs 216*f* with centers spaced radially 120 degrees from one another on the cutting surface 214*f* (FIG. 10) being present. As illustrated in FIG. 11, reliefs 216*g* may be angled, with two linear portions that meet at an angle within where the boundaries of cutting surface 214*g* would be if it were entirely circular or oval. The angle may be between 100 degrees and 170 degrees inclusive.

As shown in FIGS. 5A-11, relief 216 may reduce the surface area of flattened cutting surface 214 as compared to what the surface area would be if cutting surface were entirely circular or oval. In particular, the surface area of cutting surface 214 may be reduced by at least 5%, at least 10%, at least 20%, or by between 5% and 45%, between 5% and 30%, between 5% and 20%, between 10% and 45%, between 10% and 30%, between 20% and 30%, between 20% and 45%, or between 20% and 30%, inclusive.

Relief 216 may have a maximum radial distance 221 from a circular or oval cutting surface edge that would be present if the cutting surface 214 were entirely circular or oval that is at between ⅕ and ⅘ inclusive, or between ⅓ and ⅘, inclusive of the radius or major axis of the cutting surface 214 absent the relief.

Although the innermost cutters 203-1 described in FIGS. 5-11 have flattened cutting surfaces 214 for which the cutting arc length 217 or the surface area may be compared to what it would be if the cutting surface were absent the relief and, thus, a circle or oval, other regular flattened cutting surface shapes, such as a polygon having less than ten sides, may be used in place of a circle or an oval for comparison in some cutters. Other innermost cutters 203-1 may have an irregular flattened cutting surface 214 with reduced cutting arc length 217 or a reduced surface area. The cutting arc length 217 for such innermost cutters 203-1 may be compared to what it would be as calculated using a best fit cutting arc length of a best fit circle, oval, or polygon with less than ten sides for the flattened cutting surface absent the relief. For all of these above comparisons, the cutting arc length or surface area of the flattened cutting surface 214 may be reduced by at least 5%, at least 10%, at least 20%, or by between 5% and 45%, between 5% and 30%, between 5% and 20%, between 10% and 45%, between 10% and 30%, between 20% and 30%, between 20% and 45%, or between 20% and 30%, inclusive as compared to the surface area of the best fit circle, oval, or polygon with less than ten sides absent the relief or reliefs.

Relief 216 may extend laterally only through a portion of the layer of hard cutting material 219 (not shown), or it may extend laterally through all of the hard cutting material 219 (as illustrated particularly in FIGS. 5B, 6B, 6C, and 6D). If relief 216 extends laterally through all of hard cutting material 219, it may then extend laterally through none (not shown), a portion of (particularly as illustrated in FIGS. 5B, 6B, 6C, and 6D), or all (not shown) of substrate 220. In general, lateral extension of relief 216 through at most a portion of substrate 220 may facilitate attachment of innermost cutter 203-1 to fixed-cutter drill bit 101 by allowing the use of a circular pocket if the innermost cutter 203-1 is circular in radial cross-section. However, extension of relief 216 through all of substrate 220, coupled with a pocket having a wall that matches the shape of relief 216, may facilitate proper placement of innermost cutter 203-1 with respect to bit rotational axis 104. Relief 216 may extend linearly and axially through innermost cutter 203-1, so that it is at an approximately ninety degree angle with respect to cutting surface 214. Relief 216 may also extend linearly at an obtuse angle with respect to cutting surface 214, as illustrated by relief 216*a* in FIG. 5B. Relief 216 may also extend non-linearly in a shape, such as a curve, which generally forms an obtuse angle with respect to cutting surface 214, as illustrated by reliefs 216*b* in FIGS. 6C and 6D.

In an embodiment A, the present disclosure provides a fixed-cutter drill bit including a bit body defining a bit rotational axis, a plurality of blades each having an inner end that is radially closer to the bit rotational axis than a remainder of the respective blade, a central bit surface, and a plurality of cutters disposed on the blades and including an innermost cutter located closest among all of the plurality of cutters to the bit rotational axis and having a flattened cutting surface, a cutting arc, and a relief having ends which is located within and interrupts the cutting arc such that the cutting arc includes at least two portions located on opposite ends of the relief.

The present disclosure further provides in embodiment B a system for drilling a wellbore in a formation in which the system includes a drill string, a fixed-cutter drill bit as described in embodiment A attached to the drill string, and a surface assembly to rotate the drill string and bit during use of the bit to drill a wellbore in a formation.

Embodiments A and B may be further characterized by the following additional features, which may be combined with one another unless clearly mutually exclusive (e.g. the relief cannot be both linear and non-linear):

i) the cutting surface may be flattened;

ii) the relief may be linear;

ii-a) the innermost cutter may have a track diagram profile containing linear portion in an area corresponding to the relief, and the linear portion may be parallel to the bit rotational axis or form an acute angle with an uphole portion of the bit rotational axis of greater than 2° and less than and inclusive of 20°;

iii) the relief may be non-linear;

iii-a) the innermost cutter may have a track diagram profile containing a non-linear portion in an area corresponding to the relief for which there is a linear approximation, and the linear approximation may be parallel to the bit rotational axis or form an acute angle with an uphole portion of the bit rotational axis of greater than 2° and less than and inclusive of 20°.

iii-b) the relief may be wavy, angular, or curved;

iv) the cutting surface may include two or three reliefs;

v) the relief may extends linearly and axially through the innermost cutter such that a linear best fit for the relief forms a ninety degree angle or an obtuse angle with respect to the flattened cutting surface; and vi) the relief may be offset from the bit rotational axis from −0.25"-+0.25".

Although the present disclosure and its advantages have been described in detail, it should be understood that various changes, substitutions and alternations can be made herein without departing from the spirit and scope of the disclosure as defined by the following claims. For example, although the present disclosure describes the configurations of blades and cutting elements with respect to drill bits, the same principles may be used to control the depth of cut of any suitable drilling tool according to the present disclosure. It is intended that the present disclosure encompasses such changes and modifications as fall within the scope of the appended claims.

What is claimed is:

1. A fixed-cutter drill bit comprising:

a bit body defining a bit rotational axis;

a plurality of blades each having an inner end that is radially closer to the bit rotational axis than a remainder of the respective blade;

a central bit surface; and a plurality of cutters disposed on the blades and including an innermost cutter located closest among all of the plurality of cutters to the bit rotational axis and having a cutting surface, a cutting arc, and a relief which is located adjacent the bit rotational axis and interrupts the cutting arc such that the cutting arc includes at least two portions located on opposite ends of the relief, the relief having a wavy profile that extends inward into the cutting surface.

2. The fixed-cutter drill bit of claim 1, wherein the cutting surface of the innermost cutter is a flattened cutting surface.

3. The fixed-cutter drill bit of claim 1, wherein the cutting surface of the innermost cutter has a circular profile except for the wavy profile of the relief.

4. The fixed-cutter drill bit of claim 3, wherein the wavy profile is parallel to the bit rotational axis or forms an acute angle with an uphole portion of the bit rotational axis of greater than 2° and less than and inclusive of 20°.

5. The fixed-cutter drill bit of claim 1, wherein the wavy profile of the relief, when viewed from the top of the cutting face, includes two convex portions facing the bit rotational axis that are contiguous with the two portions of the cutting arc located on opposite ends of the relief and a concave portion facing the bit rotational axis between and contiguous with the two convex portions.

6. The fixed-cutter drill bit of claim 5, wherein the innermost cutter has a track diagram profile containing the wavy profile in an area corresponding to the relief.

7. The fixed-cutter drill bit of claim 1, wherein the innermost cutter includes a second relief circumferentially spaced from the relief, the second relief also having a wavy profile but facing away from the bit rotational axis.

8. The fixed-cutter drill bit of claim 7, wherein the relief and the second relief are on opposite sides of the cutting surface.

9. The fixed-cutter drill bit of claim 7, wherein t h e cutter is rotatable in a pocket of the fixed-cutter drill bit to re-position the cutter with the second relief adjacent the bit rotational axis.

10. The fixed-cutter drill bit of claim 1, wherein the relief is offset from the bit rotational axis from −0.25 inches to +0.25 inches.

11. A drilling system for drilling a wellbore comprising:

a drill string;

a fixed-cutter drill bit attached to the drill string; and a surface assembly to rotate the drill string and fixed-cutter drill bit during use of the fixed-cutter drill bit to drill a wellbore in a formation, wherein the fixed-cutter drill bit comprises:

a bit body defining a bit rotational axis;

a plurality of blades each having an inner end that is radially closer to the bit rotational axis than a remainder of the respective blade;

a central bit surface; and a plurality of cutters disposed on the blades and including an innermost cutter located closest among all of the plurality of cutters to the bit rotational axis and having a cutting surface, a cutting arc, and a relief which is located adjacent the bit rotational axis and interrupts the cutting arc such that the cutting arc includes at least two portions located on opposite ends of the relief, the relief having a wavy profile that extends inward into the cutting surface.

12. The drilling system of claim 11, wherein the cutting surface of the innermost cutter is a flattened cutting surface.

13. The drilling system of claim 11, wherein the cutting surface of the innermost cutter has a circular profile except for the wavy profile of the relief.

14. The drilling system of claim 13, wherein the wavy profile is parallel to the bit rotational axis or forms an acute angle with an uphole portion of the bit rotational axis of greater than 2° and less than and inclusive of 20°.

15. The drilling system of claim 14, wherein the wavy profile of the relief, when viewed from the top of the cutting face, includes two convex portions facing the bit rotational axis that are contiguous with the two portions of the cutting arc located on opposite ends of the relief and a concave portion facing the bit rotational axis between and contiguous with the two convex portions.

16. The drilling system of claim 15, wherein the innermost cutter has a track diagram profile containing the wavy profile in an area corresponding to the relief.

17. The drilling system of claim 11, wherein the innermost cutter includes a second relief circumferentially spaced from the relief, the second relief also having a wavy profile but facing away from the bit rotational axis.

18. The drilling system of claim 17, wherein the relief and the second relief are on opposite sides of the cutting surface.

19. The drilling system of claim 17, wherein the cutter is rotatable in a pocket of the fixed-cutter drill bit to re-position the cutter with the second relief adjacent the bit rotational axis.

20. The drilling system of claim 11, wherein the relief is offset from the bit rotational axis from −0.25 inches to +0.25 inches.

* * * * *